US008100040B2

(12) United States Patent
Aichele

(10) Patent No.: US 8,100,040 B2
(45) **Date of Patent: *Jan. 24, 2012**

(54) ROTARY CUTTING DEVICE

(75) Inventor: Wilhelm Aichele, Crailsheim (DE)

(73) Assignee: Aichele Werkzeuge GmbH, Crailsheim (DE)

( * ) Notice: Subject to any disclaimer, the term of this patent is extended or adjusted under 35 U.S.C. 154(b) by 1411 days.

This patent is subject to a terminal disclaimer.

(21) Appl. No.: 09/947,007

(22) Filed: Sep. 5, 2001

(65) Prior Publication Data

US 2002/0029675 A1 Mar. 14, 2002

(30) Foreign Application Priority Data

Sep. 9, 2000 (DE) ..... 100 44 705

(51) Int. Cl.
*B26D 1/22* (2006.01)

(52) U.S. Cl. ..... 83/346; 83/344; 83/506; 83/673

(58) Field of Classification Search ..... 83/331, 83/329, 469, 659, 284, 341–344, 346–348, 83/425, 425.2, 425.3, 471.1, 495, 500, 501, 83/505–507, 658, 663, 672–674, 886, 887
See application file for complete search history.

(56) References Cited

U.S. PATENT DOCUMENTS

| | | | | |
|---|---|---|---|---|
| 3,289,513 | A | 12/1966 | Johnson et al. | |
| 3,736,828 | A * | 6/1973 | Funakubo | 83/661 |
| 3,864,815 | A * | 2/1975 | Koch | 29/527.3 |
| 4,413,541 | A | 11/1983 | Biggar, III | |
| 4,641,558 | A | 2/1987 | Hoffmann | |
| 4,759,247 | A * | 7/1988 | Bell et al. | 83/346 |
| 4,770,078 | A * | 9/1988 | Gautier | 83/344 |
| 5,174,185 | A * | 12/1992 | Aichele | 83/346 |
| 5,301,583 | A * | 4/1994 | Kakko-Chiloff | 83/344 |
| 5,311,800 | A | 5/1994 | Focke et al. | |
| 5,388,490 | A | 2/1995 | Buck | |
| 5,544,549 | A | 8/1996 | Helferich | |
| 6,035,844 | A * | 3/2000 | Otani et al. | 125/15 |
| 6,244,148 | B1 * | 6/2001 | Vees | 83/348 |
| 2002/0184985 | A1 * | 12/2002 | Ishibuchi et al. | 83/342 |

FOREIGN PATENT DOCUMENTS

| | | |
|---|---|---|
| DE | 29 31 109 | 2/1981 |
| DE | 39 24 053 | 1/1991 |
| DE | 92 02 391 | 6/1992 |

(Continued)

*Primary Examiner* — Phong Nguyen
(74) *Attorney, Agent, or Firm* — Lipsitz & McAllister, LLC

(57) ABSTRACT

The invention relates to a rotary cutting device comprising a rotatable cutting tool and a rotatable anvil roller incorporating a cutting support, wherein a cutting edge, which co-operates with the cutting support, is arranged on the cutting tool for cutting a web of material, and wherein at least one support ring with a support surface is mounted on the cutting tool for supporting the cutting tool relative to the anvil roller. In order to develop the rotary cutting device in such a way as to enable high-tensile materials also to be cut in a reliable and precise manner, it is proposed, in accordance with the invention, that the cutting edge and the cutting support be made of a hard metal at least in the surface regions thereof, and in that the cutting edge be set back relative to the support surface in a radial direction, wherein the radial spacing between the cutting edge and the support surface is formed in dependence on the modulus of elasticity of the support ring in such a manner that the cutting edge virtually touches the cutting support when a bias force is applied.

20 Claims, 2 Drawing Sheets

FOREIGN PATENT DOCUMENTS

| | | |
|---|---|---|
| DE | 198 34 104 | 2/2000 |
| EP | 0 418 768 | 3/1991 |
| FR | 1 262 999 | 9/1961 |
| FR | 1 575 848 | 7/1969 |
| FR | 2 171 619 | 9/1973 |
| GB | 2 134 432 | 8/1984 |
| WO | 92/19451 | 11/1992 |

* cited by examiner

ROTARY CUTTING DEVICE

The present disclosure relates to the subject matter disclosed in German patent application No. 100 44 705.8 of Sep. 9, 2000, which is incorporated herein by reference in its entirety and for all purposes.

BACKGROUND OF THE INVENTION

The invention relates to a rotary cutting device comprising a machine frame, a cutting tool which is rotatable about a rotational axis on the machine frame and also an anvil roller with a cutting support which is rotatable about a rotational axis, wherein a cutting edge, which co-operates with the cutting support, is arranged on the cutting tool for cutting a web of material that is fed between the cutting tool and the anvil roller, and wherein at least one support ring with a support surface is mounted on the cutting tool for supporting the cutting tool relative to the anvil roller.

Continuous webs of material, for example, paper, non-woven materials, textiles, plastic or metal foils, can be cut by means of rotary cutting devices of this type. In particular hereby, it is possible to produce curved cut edges which may be in the form of a closed curve. Rotary cutting devices of this type are known from DE 39 24 053 A1 and DE 198 34 104 A1 for example.

Usually, the cutting edge projects beyond the support surface of the support ring in a radial direction with respect to the rotational axis of the cutting tool. It is thereby ensured that the cutting edge will rest on the cutting support means when cutting the material. However, an arrangement of this type has the disadvantage that a precise cut cannot be produced in every case especially when using high tensile materials, for there is then a danger that, under the influence of high bias forces such as can arise when cutting high tensile materials, the cutting edge and or the cutting support will be damaged.

The object of the present invention is to develop a rotary cutting device of the type mentioned above in such a manner that high tensile materials can also be reliably and precisely cut.

SUMMARY OF THE INVENTION

In accordance with the invention, this object is achieved in that the cutting edge and the cutting support are made of a hard metal at least in the surface regions thereof, and in that the cutting edge is set back relative to the support surface in a radial direction with respect to the rotational axis of the cutting tool, wherein the radial spacing between the cutting edge and the support surface is formed in dependence on the modulus of elasticity of the support ring in such a manner that the cutting edge virtually touches the cutting support when a bias force effective between the cutting tool and the anvil roller is exerted.

In accordance with the invention, provision is made for the cutting edge and the cutting support co-operating therewith to be made of a hard metal at least in the surface regions thereof.

Even in the case of high tensile materials, for example, aramide-fiber meshes which are highly resistant to stretching or steel meshes such as are employed for the manufacture of motor vehicle tires for example, a precise cut can thereby be effected wherein the cutting edge will only be subjected to a minimal degree of wear.

Since there is a danger that the cutting edge could break when employing hard metals for the cutting edge and the cutting support, provision is made, in accordance with the invention, for the cutting edge to have a smaller radial extent than the support surfaces of the support ring taken with respect to the rotational axis of the cutting tool. Thus, in the non-loaded state of the rotary cutting device, the cutting edge is set back relative to the support surface in the radial direction. Hereby, the radial spacing between the cutting edge and the support surface is formed in dependence on the modulus of elasticity of the support ring, i.e. in dependence on the elasticity of the material of the support ring that is being used. The underlying idea hereby is that the support ring, even if it is made of steel, is subjected to a radial deformation under the influence of a bias force between the cutting tool and the anvil roller so that the radial extent of the support ring taken with respect to the rotational axis of the cutting tool will become smaller in dependence on the particular modulus of elasticity. The relative spacing between the hard metal cutting edge and the hard metal cutting support in the non-loaded state of the rotary cutting device is now selected in such a manner that the cutting edge virtually touches the cutting support in the loaded state of the device i.e. under the influence of the bias force, whereby 'virtually touches' means that the cutting edge has the smallest possible spacing from the cutting support or is in light contact therewith. A 'light contact' of this type ensures reliable cutting of the material on the one hand, whilst breakage of the hard metal cutting edge as well as damage to the hard metal cutting support is thereby prevented on the other.

In a preferred embodiment of the invention, provision is made for the cutting edge and/or the cutting support to have a surface coating made of a hard metal.

In a particularly preferred embodiment, provision is made for the cutting edge and/or the cutting support to be made substantially entirely out of a hard metal. Consequently, high tensile materials can also be reliably cut whereby considerably longer service lifetimes can be achieved with regard to conventional rotary cutting devices.

It is expedient if the radial spacing of the cutting edge relative to the at least one support surface were to be less than approximately 500 μm when the bias force is exerted between the cutting tool and the anvil roller.

Especially reliable cutting of high tensile materials will thereby be ensured if, in the case of a preferred embodiment, the radial spacing of the cutting edge relative to the support surface were to be less than approximately 100 μm when the bias force is exerted i.e. in the loaded state of the rotary cutting device.

It is of particular advantage if the at least one support ring is made of a hard metal at least in the support surface region thereof. In an embodiment of this type, neither the cutting edge and the support surface associated therewith nor the support ring being used for supporting the cutting tool relative to the anvil roller will be subjected to any significant degree of wear so that the rotary cutting device will be characterized by a particularly long service lifetime even if high bias forces should be exerted.

Hereby, the support ring may have a surface coating consisting of a hard metal.

It has proved to be particularly advantageous if the at least one support ring is made substantially entirely out of a hard metal.

The cutting support, which is preferably made entirely of a hard metal, may be designed in the form of a cutting plate for example, whereby it is mounted on the anvil roller and the curvature thereof is matched to the curvature of the anvil roller.

It is of particular advantage if the cutting support comprises a support sleeve which peripherally surrounds a base body of the anvil roller. In an embodiment of this type, the cutting support is a snug fit on the base body of the anvil roller so that the cutting support can reliably withstand large mechanical loadings.

As an alternative, provision may be made for the cutting support to be formed in one piece with the anvil roller whereby a unitary component can be produced. An embodiment of this type is then of particular advantage if the cutting support comprises a surface coating consisting of a hard metal.

The rotary cutting device preferably comprises two support rings which are made of a hard metal and are held in relatively non-rotational manner on the cutting tool and which accommodate the cutter therebetween.

In regard to the support rings, alternative provision may also be made for the support rings to be formed in one piece with the cutting tool thereby producing a unitary component, whereby it is of particular advantage if the support rings comprise a surface coating consisting of a hard metal.

The hard metal is preferably in the form of a sintered metal that is produced using powder metallurgical techniques, for example, a sintered material comprising a metallic hard material based on tungsten and a binding agent based on cobalt. For the purposes of obtaining cutting edges and cutting supports of exceptionally high toughness, the utilization of a hard metal comprising mixed carbide crystals incorporating tungsten carbide (WC), titanium carbide (TiC), tantalum carbide (TaC) has proved to be particularly satisfactory.

As an alternative, and especially for the purposes of obtaining cutting edges and cutting supports of exceptionally high wear resistance, a hard metal may be employed wherein the hard phase thereof consists essentially of titanium carbide and/or titanium nitrite. Hard metals incorporating titanium carbide of this type are known by the term "cermet".

The hardness of the hard metal preferably amounts to more than approximately 700 HV (Vickers-hardness).

The subsequent description of a preferred embodiment will serve, in conjunction with the drawing, to provide a detailed explanation of the invention.

DETAILED DESCRIPTION OF THE INVENTION

Figure 1:
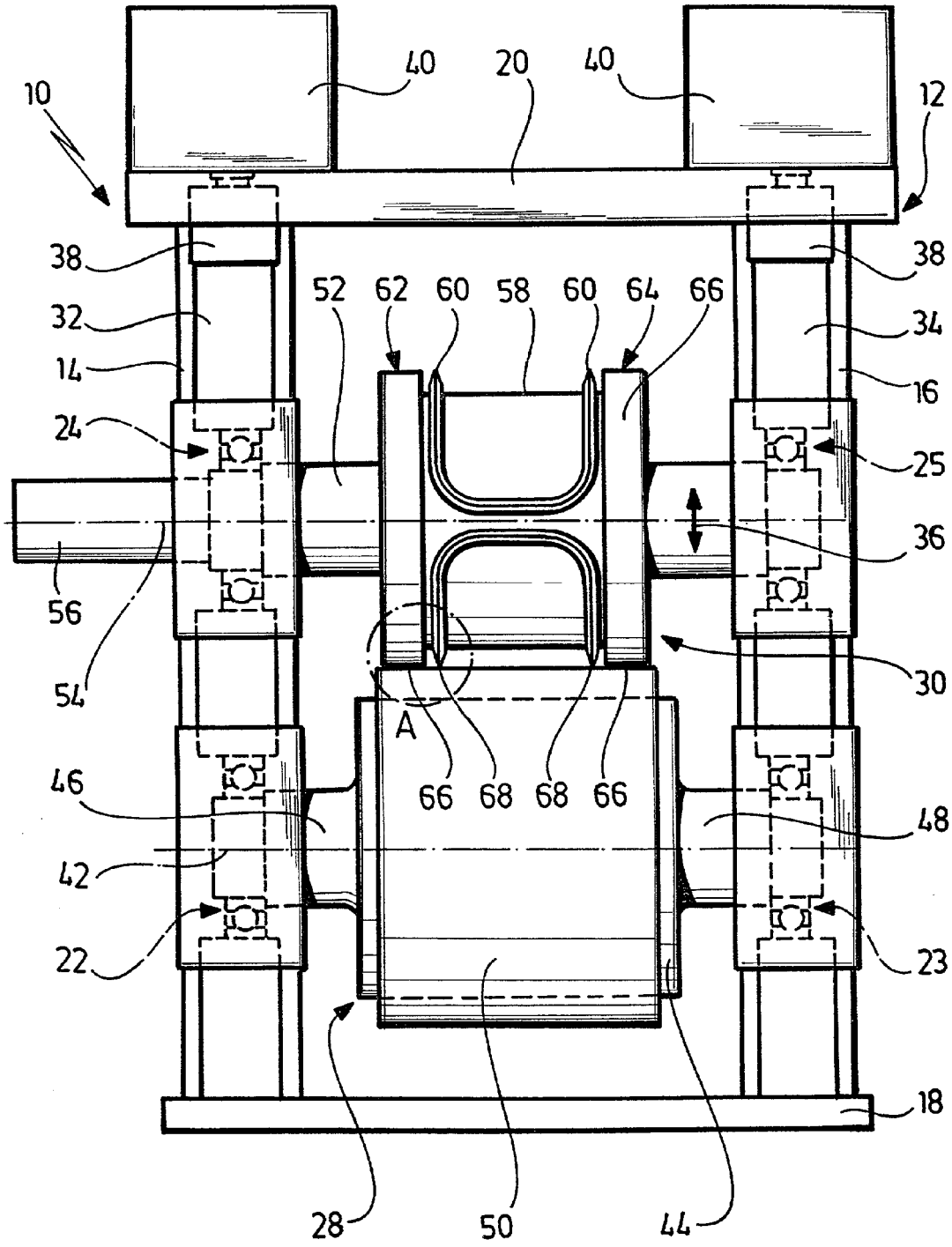
FIG. 1 shows a schematic front view of a rotary cutting device in accordance with the invention.
Figure 2:
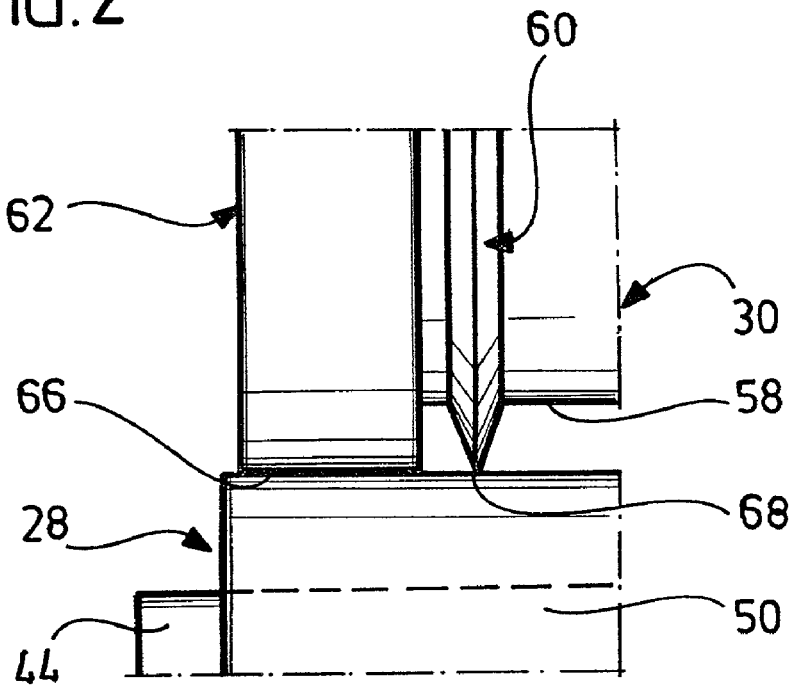
FIG. 2 an enlarged illustration of the area indicated by A in FIG. 1, in the loaded state of the rotary cutting device and FIG. 3 an enlarged illustration of the area indicated by A in FIG. 1, in the non-loaded state of the rotary cutting device.

A rotary cutting device bearing the general reference 10, which is used for cutting continuous material webs, webs of metal foil or steel mesh for example, is illustrated in the drawing.

The rotary cutting device comprises a machine frame 12 having two vertically aligned stanchions 14, 16 which are mounted on a base plate 18 and are connected to one another at their free ends by means of a cross beam 20. An anvil roller 28 and a cutting tool in the form of a cutting roller 30 are rotatably mounted between the stanchions 14, 16 of the machine frame 12 in known types of rotary bearings 22, 23 and 24, 25 respectively. The cutting roller 30 can be displaced in an adjusting device 36, which extends in parallel to the direction in which the stanchions 14, 16 extend, by means of adjusting devices 32, 34 which are mounted on the stanchions 14 and 16 and are of known type so that they are only schematically illustrated in the drawing.

The rotary bearings 24 and 25 that are employed for rotatably mounting the cutting roller 30 are supported, via the respective adjusting devices 34 and 36 and a respective biasing device 38 that is mounted in the vicinity of the free end of the stanchions 14 and 16, on a respective thrust bearing 40 which is supported by the cross beam 20. An adjustable bias force can be applied to the cutting roller 30 in the direction of the anvil roller 28 by means of the biasing device 38.

The anvil roller 28 is freely rotatable about a rotational axis 42 and comprises a cylindrical base body 44 having stub shafts 46, 48 mounted on its end faces, said stub shafts being mounted in the respective rotary bearings 22 and 23. Moreover, the anvil roller 28 comprises a support sleeve 50 which peripherally surrounds the base body 44 and is a snug fit on the base body 44 and which is made from a hard metal produced by a powder metallurgical process whose hardness phase consists essentially of tungsten carbide (WC) and the binding agent whereof consists essentially of cobalt.

The cutting roller 30 is held in a relatively non-rotational manner on a tool shaft 52 which is mounted in the rotary bearings 24 and 25 and is freely rotatable about a rotational axis 54, whereby a drive shaft 56 extends through the rotary bearing 24. The cutting roller 30 is adapted to be driven via the drive shaft 56 by means of a motor and transmission arrangement which is known and is therefore not illustrated in the drawing for that reason.

The cylindrical cutting roller 30 comprises a cutting edge 60 having a substantially wedge-shaped cross-section which is located on the outer surface region 58 of the cylinder and extends peripherally about the outer cylindrical surface 58 as well as in the axial direction with respect to the rotational axis 54 of the cutting roller 30 thereby forming a closed curve.

Two support rings 62, 64 are held in non-rotational manner on the end faces of the cutting roller 30. These support rings are arranged at each side of the cutter 30 and are aligned co-axially relative to the rotational axis 54 of the cutting roller 30 and comprise a respective support surface 66 which is aligned cylindrically relative to the rotational axis 54 and rests on the support sleeve 50 of the anvil roller 28 on each side of the cutting edge 60.

As has been previously explained, the cutting roller 30 can be braced against the anvil roller 28 by means of the biasing devices 38, whereby the cutting roller 30 is supported on the anvil roller 28 by means of the support rings 62, 64. The two support rings 62, 64 axially bound a cutting zone into which a continuous web of material can be introduced between the cutting roller 30 and the anvil roller 28, whereby an area of the material as defined by the shape of the cutting edge 60 can be cut out by rotating the cutting roller 30 together with the anvil roller 28.

Figure 3:
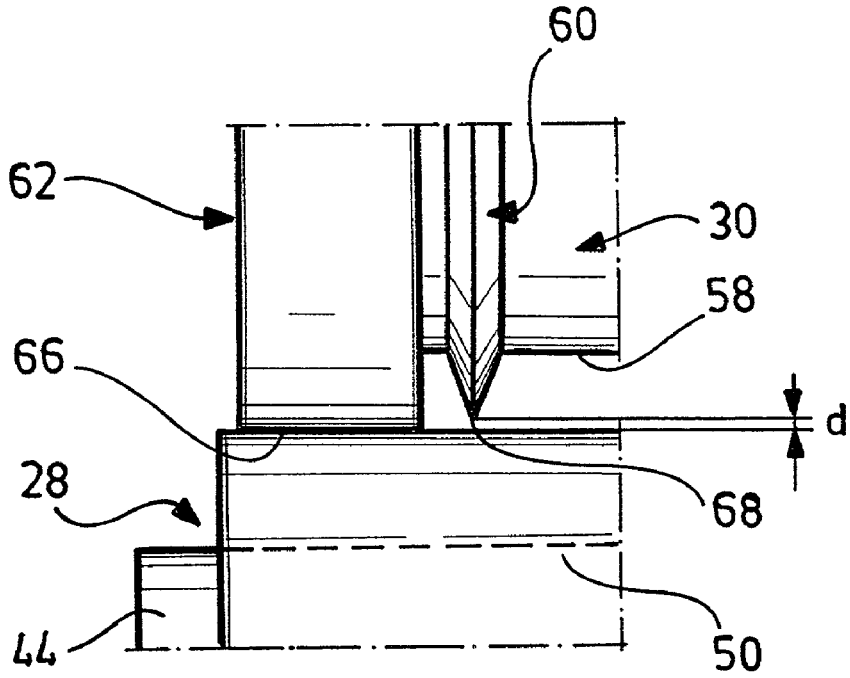

In order to ensure that the cut is as precise as possible and that the cutting edge 60 and the support rings 62, 64 are subjected to as little wear as possible even when cutting high tensile materials, steel meshes that are highly resistant to stretching for example, the cutting edge 60 and the support rings 62, 64 are made of the selfsame hard metal that is also employed for producing the support sleeve 50. Since the hard metal only has a proportionately small resistance to breakage, provision is made for the cutting edge 60 to extend to a smaller radial extent taken with respect to the rotational axis 54 of the cutting roller 30 than the support surface 66 in the non-loaded state of the rotary cutting machine 10 i.e. in a state in which there is no bias force effective on the cutting roller 30. This will become clearer from the enlarged illustration shown in FIG. 3. Thus, in the non-loaded state, the tip 68 of the cutting edge 60 is radially spaced from the support surface 66 by the distance d. This spacing preferably amounts to less than 500 μm, and especially to less than 100 μm, and may amount to approximately 80 μm for example. The magnitude of the spacing d is selected in dependence on the modulus of elasticity of the support rings 62, 64 in such a manner that the tip 68 of the cutting edge practically touches the surface of the support sleeve 50 when a bias force is exerted on the cutting roller 30 in a direction towards the anvil roller 28 by means of the biasing devices 38 when cutting the material. Hereby, the underlying idea is that the support rings 62, 64 consisting of a hard metal are subjected to a deformation in the radial direction when subjected to the bias force so that the radial extent thereof with respect to the rotational axis 54 of the cutting roller 30 will reduce. The spacing d between the cutting edge tip 68 and the support surface 66 in the non-loaded state of the rotary cutting device 10 is selected in such a manner that it will be practically compensated by the radial deformation of the support rings 62, 64 in the loaded state, whereby, however, it is ensured that the cutting edge tip 68 will also not project radially beyond the support surface 66 when in the loaded state, so that damage to the hard metal cutting edge 60 is reliably prevented during the operation of the rotary cutting device 10.

The magnitude of the radial spacing d between the cutting edge tip 68 and the support surface 66 is thus dependent on the modulus of elasticity of the hard metal material that is used for making the support rings 62, 64. The larger the modulus of elasticity, i.e. the stiffer the hard metal material, the smaller the radial spacing d which can be selected for ensuring that the cutting edge tip 68 will be set back in the radial direction with respect to the support surfaces 66 of the support rings 62, 64. An arrangement of this type enables the use of a hard metal for the cutting edge 60, the support sleeve 50 and the support rings 62, 64 thereby ensuring precise cutting even of high tensile materials and even after the rotary cutting device 10 has been in service for a long time.

The invention claimed is:

1. A rotary cutting device comprising:

a machine frame;

a cutting tool which is rotatable about a rotational axis on the machine frame;

an anvil roller with a cutting support which is rotatable about a rotational axis, the cutting support comprising a support sleeve which surrounds a base body of the anvil roller;

a cutting edge being arranged on said cutting tool for cutting a web of material that is fed between said cutting tool and said anvil roller and which co-operates with said cutting support, wherein said cutting edge and said cutting support are made of a hard metal at least in the surface regions thereof;

at least one support ring with a support surface mounted on said cutting tool for supporting said cutting tool relative to said anvil roller;

wherein:

said cutting edge is set back relative to the support surface in a radial direction with respect to said rotational axis of said cutting tool, the radial spacing between said cutting edge and said support surface being formed in dependence on the modulus of elasticity of said at least one support ring in such a manner that said cutting edge almost touches said cutting support when a bias force effective between said cutting tool and said anvil roller is exerted; and the hard metal comprises one of: (i) a sintered material comprising a metallic hard material based on tungsten and a binding agent based on cobalt; or (ii) a sintered material comprising a hard material incorporating titanium carbide.

2. A rotary cutting device in accordance with claim 1, wherein the cutting edge and/or the cutting support have a surface coating made of a hard metal.

3. A rotary cutting device in accordance with claim 1, wherein the cutting edge and/or the cutting support are made substantially entirely out of a hard metal.

4. A rotary cutting device in accordance with claim 1, wherein the relative radial spacing between the cutting edge and the support surface is less than approximately 500 μm when the bias force is exerted.

5. A rotary cutting device in accordance with claim 1, wherein the relative radial spacing between the cutting edge and the support surface is less than approximately 100 μm when the bias force is exerted.

6. A rotary cutting device in accordance with claim 1, wherein the at least one support ring is made of a hard metal at least in the support surface region thereof.

7. A rotary cutting device in accordance with claim 1, wherein the at least one support ring is made substantially entirely out of a hard metal.

8. A rotary cutting device in accordance with claim 1, wherein the rotary cutting device comprises two support rings which are made of a hard metal and are held in relatively non-rotational manner on the cutting tool and which accommodate the cutting edge therebetween.

9. A rotary cutting device in accordance with claim 1, wherein the hardness of the hard metal amounts to more than approximately 700 HV (Vickers-hardness).

10. A rotary cutting device comprising:

a machine frame;

a cutting tool which is rotatable about a rotational axis on the machine frame;

an anvil roller with a cutting support which is rotatable about a rotational axis, the cutting support comprising a support sleeve which surrounds a base body of the anvil roller;

a cutting edge being arranged on said cutting tool for cutting a web of material that is fed between said cutting tool and said anvil roller and which co-operates with said cutting support, wherein said cutting edge and said cutting support comprise, at least in the surface regions thereof, at least one of tungsten carbide, titanium carbide, tantalum carbide, and titanium nitride;

two support rings with corresponding support surfaces mounted on respective end faces of said cutting tool for supporting said cutting tool relative to said anvil roller;

wherein:

in a non-loaded state said cutting edge is set back relative to the support surfaces to provide a spacing therebetween in a radial direction with respect to said rotational axis of said cutting tool, the radial spacing between said cutting edge and said support surfaces in said non-loaded state being formed in dependence on the modulus of elasticity of said support rings in such a manner that said cutting edge almost touches said cutting support in a loaded state when a bias force effective between said cutting tool and said anvil roller is exerted, said radial spacing is achieved without use of any spring mechanism independent of the support rings, and in the loaded state, said cutting edge does not project beyond the support surfaces.

11. A rotary cutting device in accordance with claim 10, wherein the cutting edge and/or the cutting support have a surface coating made of tungsten carbide.

12. A rotary cutting device in accordance with claim 10, wherein the cutting edge and/or the cutting support are made substantially entirely out of tungsten carbide.

13. A rotary cutting device in accordance with claim 10, wherein the relative radial spacing between the cutting edge and the support surface is less than approximately 500 μm when the bias force is exerted.

14. A rotary cutting device in accordance with claim 10, wherein the relative radial spacing between the cutting edge and the support surface is less than approximately 100 μm when the bias force is exerted.

15. A rotary cutting device in accordance with claim 10, wherein said support rings are made of a hard metal at least in a region of the support surfaces.

16. A rotary cutting device in accordance with claim 10, wherein said support rings are made substantially entirely out of a hard metal.

17. A rotary cutting device in accordance with claim 10, wherein the two support rings are made of a hard metal and are held in relatively non-rotational manner on the cutting tool.

18. A rotary cutting device in accordance with claim 10, wherein the hardness of the cutting edge and the cutting support, at least in the surface regions thereof, amounts to more than approximately 700 HV (Vickers-hardness).

19. A rotary cutting device in accordance with claim 10, wherein the cutting edge and the cutting support, at least in the surface regions thereof, comprise a sintered material comprising a metallic hard material based on tungsten and a binding agent based on cobalt.

20. A rotary cutting device in accordance with claim 10, wherein the cutting edge and the cutting support, at least in the surface regions thereof, comprise a sintered material comprising a hard material incorporating titanium carbide.

* * * * *